US009878335B2

(12) United States Patent
Müller et al.

(10) Patent No.: US 9,878,335 B2
(45) Date of Patent: Jan. 30, 2018

(54) SPRAY MIXER FOR MIXING AND SPRAYING AT LEAST TWO FLOWABLE COMPONENTS

(71) Applicant: SULZER MIXPAC AG, Haag (CH)

(72) Inventors: Jörg Müller, Winterthur (CH); Richard Lavelanet, Balgach (CH)

(73) Assignee: SULZER MIXPAC AG, Haag (CH)

( * ) Notice: Subject to any disclaimer, the term of this patent is extended or adjusted under 35 U.S.C. 154(b) by 51 days.

(21) Appl. No.: 14/400,984

(22) PCT Filed: Apr. 22, 2013

(86) PCT No.: PCT/EP2013/058281

§ 371 (c)(1),
(2) Date: Nov. 13, 2014

(87) PCT Pub. No.: WO2013/171030

PCT Pub. Date: Nov. 21, 2013

(65) Prior Publication Data

US 2015/0102132 A1 Apr. 16, 2015

(30) Foreign Application Priority Data

May 14, 2012 (EP) ..... 12167892

(51) Int. Cl.
*B05B 7/06* (2006.01)
*B01F 3/10* (2006.01)
(Continued)

(52) U.S. Cl.
CPC ..... *B05B 7/0408* (2013.01); *B01F 3/10* (2013.01); *B01F 5/0609* (2013.01); *B05B 7/066* (2013.01);
(Continued)

(58) Field of Classification Search
CPC ..... B05B 7/06; B05B 7/066; B05B 7/0408; B05B 7/2491; B05B 7/2497;
(Continued)

(56) References Cited

U.S. PATENT DOCUMENTS 3,166,221 A * 1/1965 Nielsen ..... A61M 3/00 222/137
4,255,125 A * 3/1981 Auclair ..... F23D 11/102 239/402
(Continued)

FOREIGN PATENT DOCUMENTS

CN 2130604 Y 4/1993
EP 0749776 A1 12/1996
(Continued)

OTHER PUBLICATIONS

International Preliminary Report for International Patent Application No. PCT/EP2013/058281 dated Nov. 27, 2014.

*Primary Examiner* — Darren W Gorman
*Assistant Examiner* — Joseph A Greenlund
(74) *Attorney, Agent, or Firm* — Global IP Counselors, LLP

(57) ABSTRACT

The invention relates to a spray mixer for mixing and spraying at least two flowable components. The spray mixer (22) is provided with a tubular outer mixer housing (23) which extends in the direction of a mixer longitudinal axis (24) from a mixer start (25) to a distal mixer end (26). A mixer inner housing (29) which accommodates a mixer element (33) is arranged in the mixer outer housing (23). A mixer compressed air inlet (31) is arranged at the mixer start (25). The mixer compressed air inlet (31) is connected by means of a mixer compressed air channel (30) to an annular mixer compressed air outlet (32) which encloses a mixer outlet opening (35). In the operation of the spray mixer (22), compressed air is supplied via the mixer compressed air inlet
(Continued)

(31), flows through the mixer compressed air channel (30) to the mixer compressed air outlet (32) and atomizes and sprays the material emerging from the mixer outlet opening (35). In order for the spray mixer to be easy to handle, the mixer outer housing (23), the mixer inner housing (29) and the mixer element (33) are combined in a single unit. This is achieved by connecting the indicated components to each other in a manner to secure against loss.

10 Claims, 2 Drawing Sheets

(51) Int. Cl.
*B05B 7/04* (2006.01)
*B05C 17/005* (2006.01)
*B01F 5/06* (2006.01)
*B05B 7/24* (2006.01)

(52) U.S. Cl.
CPC ..... *B05B 7/2491* (2013.01); *B05B 7/2497* (2013.01); *B01F 5/0602* (2013.01); *B05B 7/06* (2013.01); *B05B 7/2472* (2013.01); *B05C 17/00553* (2013.01); *B05C 17/00566* (2013.01)

(58) Field of Classification Search
CPC .... B05B 7/2472; B01F 5/0602; B01F 5/0609; B01F 3/10; B05C 17/00553; B05C 17/00566
USPC ..... 239/428, 428.5, 432, 427, 419.3, 398; 222/135, 145.1, 145.5, 145.6, 137
See application file for complete search history.

(56) References Cited

U.S. PATENT DOCUMENTS 5,486,676 A * 1/1996 Aleshin ..... B23K 26/144 219/121.63
5,536,531 A * 7/1996 Owen ..... B05B 7/066 222/326
5,725,499 A * 3/1998 Silverstein ..... A61M 5/19 222/145.1
5,851,067 A 12/1998 Fleischli et al.
5,944,419 A * 8/1999 Streiff ..... B01F 5/0641 366/337
6,062,492 A * 5/2000 Tudor ..... B01F 5/0614 239/296
6,082,637 A * 7/2000 Ludwig ..... B05C 5/02 138/112
6,131,823 A * 10/2000 Langeman ..... B05B 7/0408 239/291
6,250,567 B1 * 6/2001 Lewis ..... B05B 7/0408 239/292
6,601,782 B1 * 8/2003 Sandholm ..... B05B 7/066 239/427
6,951,310 B2 * 10/2005 Anderson ..... B05B 7/0861 239/427
7,815,384 B2 * 10/2010 Parks ..... B01F 5/0615 239/398
8,523,806 B2 * 9/2013 Hayakawa ..... B05B 7/0408 604/24
8,534,575 B2 * 9/2013 Brem ..... A61B 17/00491 222/137
8,684,282 B2 * 4/2014 Steffen ..... A61B 17/00491 222/145.5
2003/0136859 A1 * 7/2003 Borden ..... B05C 17/00513 239/1
2003/0209612 A1 * 11/2003 Hahnen ..... A61B 17/00491 239/398
2003/0226910 A1 12/2003 Anderson
2006/0208000 A1 * 9/2006 Murray ..... B29B 7/7404 222/135
2007/0069040 A1 * 3/2007 Lewis ..... B05B 7/066 239/8
2008/0203112 A1 * 8/2008 Peuker ..... A61M 5/19 222/137
2009/0124986 A1 * 5/2009 Hayakawa ..... B01F 5/0262 604/290
2009/0152300 A1 * 6/2009 Hayman ..... B01F 5/0615 222/145.6
2011/0042483 A1 * 2/2011 Hiemer ..... B01F 5/0641 239/143
2012/0305669 A1 * 12/2012 Meron ..... A61B 17/00491 239/428
2013/0112778 A1 * 5/2013 Hiemer ..... B05B 7/04 239/398
2013/0253580 A1 * 9/2013 Suzuki ..... A61B 17/00491 606/214
2014/0117046 A1 * 5/2014 Ettlin ..... B05C 17/00553 222/145.5
2015/0091094 A1 * 4/2015 Wan ..... H01L 27/1211 257/369
2015/0108251 A1 * 4/2015 Muller ..... B05C 17/00553 239/304

FOREIGN PATENT DOCUMENTS

EP 0815929 A1 1/1998
EP 2286925 A2 2/2011

* cited by examiner

SPRAY MIXER FOR MIXING AND SPRAYING AT LEAST TWO FLOWABLE COMPONENTS

PRIORITY CLAIM

The present application is a National Stage of International Application No. PCT/EP2013/058281, filed on Apr. 22, 2013, which claims priority to European Patent Application No. 12167892.4 filed on May 14, 2012, the entire contents of which are being incorporated herein by reference.

BACKGROUND

The invention relates to a spray mixer for mixing and spraying at least two flowable components in accordance with the preamble of claim 1.

Mixers for mixing at least two flowable components in the form of so-called static mixers are described, for example, in EP-A 0 749 776 and EP-A 0 815 929. These very compact mixers provide good mixing results, in particular also on the mixing of high-viscosity materials such as sealing compounds, two-component foams or two-component adhesives, despite a simple, material-saving design of their mixer structure. Such static mixers are usually designed for single use and are frequently used for products to be hardened in which the mixer can practically no longer be cleaned.

The components to be mixed are usually supplied to those mixers by a multicomponent cartridge. For this purpose, the mixer is arranged at a cartridge outlet opening via which the components to be mixed can be dispensed from containers of the multicomponent cartridge.

In some applications in which such static mixers are used, it is desirable to spray the two components onto a substrate after their mixing in the mixer. For this purpose, the mixed components are atomized at the outlet of the mixer by the action of a pressurized medium such as compressed air and can then be applied to the desired substrate in the form of a spray jet or spray mist. In particular more highly viscous coating media, e.g. polyurethane, epoxy resins or similar, can also be processed using these technologies.

A spray mixer for such applications is disclosed, for example, in U.S. Pat. No. 6,951,310 or in EP 2 286 925 A2. In this apparatus, a tubular mixer housing is provided which extends in the direction of a longitudinal mixer axis from a mixer start up to a distal mixer end. The mixer housing receives a mixing element for a static mixing. A sleeve is arranged at the distal end of the mixer housing and compressed air can be supplied to it via a mixer inlet for compressed air oriented perpendicular to the longitudinal mixer axis. The named sleeve and the mixer housing form a mixer passage for compressed air which is terminated in the direction of the mixer start and has a ring-shaped mixer outlet for compressed air at the mixer end which surrounds a mixer outlet opening. Compressed air which flows via the mixer passage for compressed air to the mixer outlet for compressed air and which atomizes the material exiting the mixer outlet opening is supplied via the mixer inlet for compressed air in operation of the mixer.

The supply of compressed air to the mixer inlet for compressed air takes place via a hose which is not described in more detail and which is likewise oriented perpendicular to the longitudinal mixer axis due to the named orientation of the mixer inlet for compressed air.

Such spray mixers are used in systems for mixing and spraying flowable components which are in particular used for the application of coatings in the maintenance of ship hulls, pipelines and steel constructions such as bridges. It is also necessary in this respect to coat points with difficult access. It can occur in the coating of such points that hoses or lines of the coating system such as the above-described compressed air hose get caught at projections of the component to be coated. In this respect, on the one hand, the named hoses and lines may be damaged, which results in the failure of the coating system and thus in repair costs and delays in the maintenance work. On the other hand, an operator of the coating system has to work very carefully and thus also slowly at tight points, which can result in a high time effort, and thus also cost effort, in the use of the coating system.

A spray mixer is described in U.S. Pat. No. 6,131,823 which has a handle and an outer mixer housing in the form of a sleeve. The handle and the sleeve are manufactured from aluminum. In a first work step, a mixer which is made from plastic and which is composed of an inner mixer housing and a mixing element arranged therein can be placed onto the handle. In a second work step, the sleeve can be put over the mixer and can be screwed to the handle. A compressed air passage is formed between the sleeve and the inner mixer housing and compressed air can be conducted via said compressed air passage from the handle to an outlet. The mixer is in this respect only provided for a single use, with the sleeve being used a multiple of times. The handle has ports for the flowable components and for compressed air.

U.S. Pat. No. 4,255,125 describes an atomization apparatus for a combustible material having a feed inlet for the combustible material and a further feed inlet for an atomization gas. The combustible material and the atomization gas are combined in an atomization chamber within the atomization apparatus and are subsequently conducted through a mixing element in the form of curved elements.

SUMMARY

In view of this, it is the object of the invention to propose a spray mixer for mixing and spraying at least two flowable components which can be handled simply.

The spray mixer for mixing and spraying at least two flowable components has a tubular outer mixer housing which extends in the direction of a longitudinal mixer axis from a mixer start up to a distal mixer end. In addition, it has an inner mixer housing arranged inside the outer mixer housing, at least one mixing element which is arranged in the inner mixer housing for mixing the components and a mixer passage for compressed air which extends from a mixer compressed air inlet to a mixer outlet opening.

The mixer inlet for compressed air is arranged at the mixer start. The mixer passage for compressed air thus extends from the mixer start to the mixer end along the spray mixer. In operation of the spray mixer, the latter is usually arranged at a multicomponent cartridge and projects away from it. No compressed air feed to the mixer end and thus no hose to the mixer end is necessary due to the arrangement of the mixer inlet for compressed air at the mixer start. The spray mixer can thus also be introduced into tight intermediate spaces without there being any risk of a compressed air hose catching anywhere.

The compressed air supply to the mixer inlet for compressed air can take place perpendicular to the longitudinal mixer axis. It can, however, also be inclined with respect to the longitudinal mixer axis and can in particular take place in the direction of the longitudinal mixer axis.

An inner mixer housing which receives the mixing element is arranged within the outer mixer housing. The mixer passage for compressed air is formed between the inner mixer housing and the outer mixer housing. The outer mixer housing and the inner mixer housing are therefore designed so that an intermediate space is formed between the two in the assembled state which is used as a mixer passage for compressed air. A particularly simple design of the spray mixer thus results.

In accordance with the invention, the outer mixer housing, the inner mixer housing and the mixing element are combined in one structural unit. This is achieved in that the outer mixer housing, the inner mixer housing and the mixing element are connected to one another captively (i.e. in a non-losable manner). For this purpose, in particular the individual components are mutually fixed via a cooperation of corresponding cut-outs or grooves and noses or beads. Such fixing arrangements are also called clip connections or click connections. The total spray mixer in particular forms one structural unit which is marketed as a unit. The placing or connecting of the spray mixer onto or to a multicomponent cartridge is thus particularly simple, since the named parts do not first have to be put together, but the spray mixer can rather be used without any previous assembly.

In an embodiment of the invention, the spray mixer is provided to be connected to a multicomponent cartridge in one work step. This is to be understood such that, without a previous assembly of individual components, the spray mixer can be connected to the multicomponent cartridge.

In an embodiment of the invention, the spray mixer has a mixer inlet connector which is arranged at the mixer start and which can be connected to the cartridge outlet connector of a multicomponent cartridge. The mixer inlet connector has at least one mixer inlet opening via which the components can be supplied. It moreover includes the mixer inlet for compressed air. Both the connections for the components to be mixed and the connector for the compressed air can thus be established via the one mixer inlet connector, which allows a particularly simple handling of the spray mixer since only one work step is necessary for connecting the spray mixer to the multicomponent cartridge.

The spray mixer can in this respect in particular be directly connected to the cartridge outlet connector of the multicomponent cartridge. It is, however, also possible that the connection takes place by means of a suitable connection element, for example in the form of suitable hoses.

The mixer inlet connector is in particular oriented in the direction of the longitudinal mixer axis. It is to be understood by this that the components and the compressed air flow in the direction of the longitudinal mixer axis through the mixer inlet connector. A particularly compact design of the spray mixer is thus achieved.

A particularly configured multicomponent cartridge is required for this embodiment of the spray mixer in accordance with the invention which has a cartridge passage for compressed air having a cartridge inlet for compressed air and a cartridge outlet for compressed air. A separate compressed air hose is thus no longer at all necessary for the compressed air supply of the spray mixer, which allows a particularly simple and reliable handling of the spray mixer.

The mixer inlet connector in particular has two separate mixer inlet openings, that is one separate mixer inlet opening for each component. A particularly effective mixing of the two components is thus made possible. If more than two components are to be mixed and sprayed using the spray mixer, the mixer inlet connector in particular has a separate mixer inlet opening for each component.

The mixing element is in particular designed as a static mixing element. In contrast to a dynamic mixer which has a rotating mixing element for mixing the components, a static mixer has a fixed-position mixing element which allows an efficient mixing of the components due to its special geometry. This allows a particularly inexpensive design of the spray mixer.

In an embodiment of the invention, the mixing element and the mixer inlet connector are designed in one piece. The spray mixer thus has particularly few individual parts, which makes its manufacture and its assembly particularly simple and inexpensive.

It is, however, possible that the mixing element and the mixer inlet connector are made as two separate components.

In an embodiment of the invention, the outer mixer housing, the inner mixer housing and the mixing element are made of plastic. The spray mixer thus has a particularly low weight and can also be manufactured inexpensively. The components can be composed of, for example, polypropylene, polyamide, polycaprolactam (polyamide 6) or polybutylene terepththalate). Other suitable plastics are, however, also possible.

The manufacture of the outer mixer housing, of the inner mixer housing and of the mixing element in particular takes place by means of an injection molding process. The components can thus be manufactured simply in very large volumes and particularly inexpensively.

Further advantages, features and details of the invention result with reference to the following description of embodiments and with reference to drawings in which elements which are the same or have the same function are provided with identical reference numerals.

There are shown:

BRIEF DESCRIPTION OF THE FIGURES

FIG. 1 a multicomponent cartridge for receiving a multicomponent cartridge for receiving flowable components with a spray mixer plugged on;

DETAILED DESCRIPTION

Figure 1:
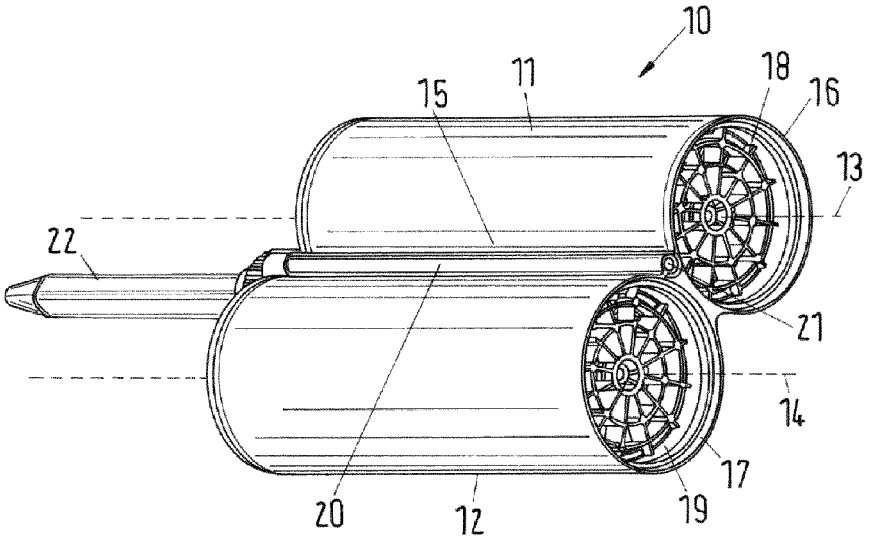

In accordance with FIG. 1, a multicomponent cartridge 10 has a first container 11 for receiving a first component and a second container 12 for receiving a second component. The first and second containers 11, 12 have a cylindrical base shape having a first cylinder axis 13 and a second cylinder axis 14. The two containers 11, 12 are arranged paraxially next to one another. The containers 11, 12 are connected to one another and have a minimal spacing from one another. A notch 15 thus results between the two containers which extends in parallel to the two cylinder axes 13, 14. The multicomponent cartridge 10 is thus designed as a so-called side-by-side cartridge. The containers 11, 12 of the multicomponent cartridge 10 have the same diameter. A mixing ratio of the components on the dispensing from the containers 11, 12 thus amounts to 1:1. Other diameters, and thus mixing ratios, are also possible however, such as 1:2, 1:4, 1:10 or higher.

At en end face of the containers 11, 12 they each have a filling opening 16, 17 which extends over the total end face of the containers 11, 12. The containers 11, 12 can be filled with a corresponding flowable component via the filling openings 16, 17. The filling openings 16, 17 are closed by a respective piston 18, 19 in the representation of FIG. 1. The pistons 18, 19 are inserted after the filling of the containers 11, 12. The components can be dispensed by displacing the pistons 18, 19 away from the filling openings 16, 17 via two cartridge outlet openings which are arranged at a side of the multicomponent cartridge 10 disposed opposite the filling openings 16, 17. The cartridge outlet openings cannot be seen in the representation of FIG. 1.

A cartridge passage for compressed air 20 runs in the notch 15 between the two containers 11, 12. The cartridge passage for compressed air 20 has a circular cross-section and extends from a cartridge inlet for compressed air 21 to a cartridge outlet for compressed air not shown in FIG. 1. The cartridge inlet for compressed air 21 is arranged in a plane with the filling openings 16, 17 of the containers 11, 12. The cartridge outlet for compressed air is located in the area of the cartridge outlet openings. The cartridge passage for compressed air 20 thus extends over the total length of the containers 11, 12 and thus also of the multicomponent cartridge 10.

The first container 11, the second container 12 and the passage for compressed air 20 are made in one piece. In addition, no separate component are likewise required for the cartridge outlet openings, not shown, and the cartridge outlet for compressed air so that the total multicomponent cartridge 10 is thus made in one piece. The multicomponent cartridge 10 is manufactured from plastic by means of an injection molding process. Polypropylene, polyamide, polycaprolactam (polyamide 6) or polybutylene terepththalate can be used for this purpose.

A spray mixer 22 is arranged on the side of the multicomponent cartridge 10 disposed opposite the filling openings 16, 17. The spray mixer 22 is connected via a cartridge outlet connector, not shown in FIG. 1, to the multicomponent cartridge 10 such that connections arise to the cartridge outlet openings and to the cartridge outlet for compressed air. The components dispensed from the containers 11, 12 are mixed by the spray mixer 22 and are atomized and sprayed by means of the compressed air supplied via the cartridge passage for compressed air 20. The design of the spray mixer 22 is shown more precisely in FIG. 2.

Figure 2:
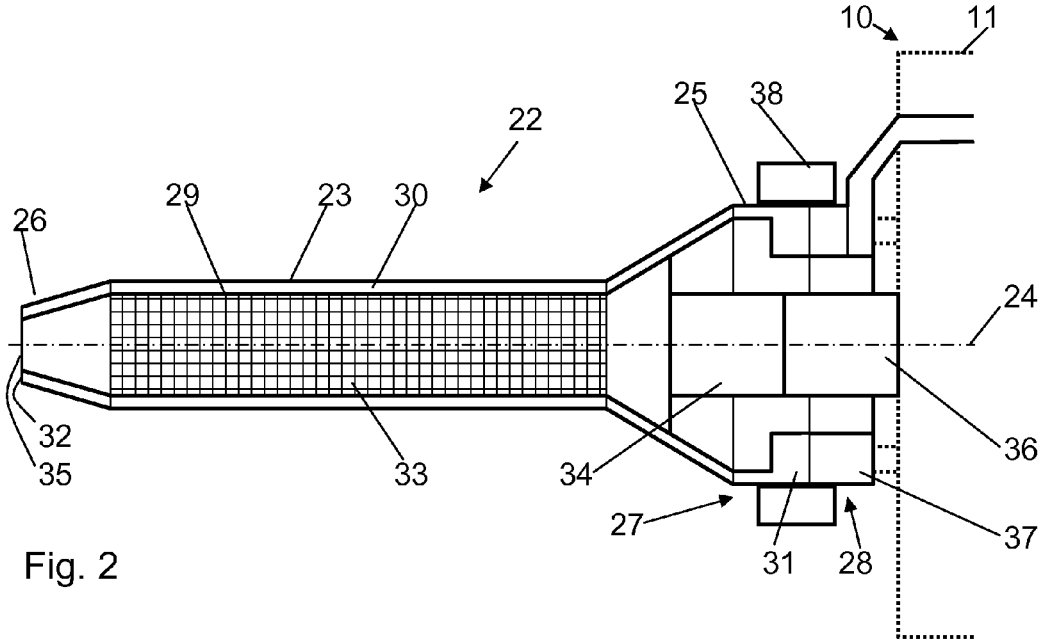
FIG. 2 a spray mixer connected to a multicomponent cartridge.

The spray mixer 22 for mixing and spraying at least two flowable components is shown in a sectional representation in FIG. 2. The section runs in parallel to the cylinder axes 13, 14 between the two containers 11, 12 with respect to FIG. 1. A small part of the multicomponent cartridge 10 is moreover shown in FIG. 2. A part of the container 11 of the multicomponent cartridge 10 which lies behind the section plane is shown dotted for better understanding.

The spray mixer 22 has a mainly tubular outer mixer housing 23 which extends in the direction of a longitudinal mixer axis 24 from a mixer start 25 up to a distal mixer end 26. The spray mixer 22 is connected to the multicomponent cartridge 10 at the mixer start 25.

The outer mixer housing 23 has a constant cross-section in a middle region and tapers a little toward the mixer end 26. The outer mixer housing 23 widens toward the mixer start at the opposite side and forms a part of a mixer inlet connector 27 by means of which the spray mixer 22 is connected to a cartridge outlet connector 28 of the multicomponent cartridge 10.

An inner mixer housing 29 is arranged within the outer mixer housing 23 and has an outer contour corresponding to the contour of the outer mixer housing 23 so that a ring-shaped hollow space which serves as a mixer passage for compressed air 30 results between the outer mixer housing 23 and the inner mixer housing 29. Compressed air can be supplied to the mixer passage for compressed air 30 via a mixer inlet for compressed air 31 which likewise forms a part of the mixer inlet connector 27. The mixer inlet for compressed air 31 is thus arranged at the mixer start 25. The compressed air is conducted via the mixer passage for compressed air 30 to a mixer outlet for compressed air 32 which is located at the mixer end 26.

A static mixing element 33 which serves for mixing the two components is arranged within the inner mixer housing 29. The mixing element 33 is made in one piece with a mixer inlet opening 34 via which a first component can be supplied to the spray mixer 22. The mixing element 33 has a second mixer inlet opening via which a second component can be supplied. It is, however, not in the sectional plane shown so that this second mixer inlet opening is not shown in FIG. 2. The mixer inlet opening 34 has a circular cross-section and likewise forms a part of the mixer inlet connector 27.

The two mixer inlet openings are connected to corresponding cartridge outlet openings, with only one cartridge outlet opening 36 being visible in FIG. 2 which is connected to the mixer inlet opening 34. The cartridge outlet opening 36 is part of the cartridge outlet connector 28.

At the mixer end 26, the inner mixer housing 29 has a mixer outlet opening 35 via which the components mixed by the mixing element 33 can exit the inner mixer housing 29. The mixer outlet for compressed air 32 is arranged around the mixer outlet opening 35. The mixed components exiting the mixer outlet opening 35 are thus atomized and sprayed. In addition, grooves or similar can also be arranged in the region of the mixer outlet opening 35 and of the mixer outlet for compressed air 32 which provide a swirling of the compressed air and thus an effective atomization of the mixed components.

The mixer inlet for compressed air 31 is connected to a cartridge outlet for compressed air 37 of the multicomponent cartridge 10 which provides the cartridge passage for compressed air 20 with compressed air. The cartridge passage for compressed air 20 kinks in the direction of the longitudinal mixer axis 24 for this purpose. The mixer inlet for compressed air 31 and the cartridge outlet for compressed air 37 have a ring-shaped cross-section and are arranged around the mixer inlet openings 34 and the cartridge outlet openings 36. The mixer inlet for compressed air 31 is in this respect a part of the mixer inlet connector 27 and the cartridge outlet for compressed air 37 is a part of the cartridge outlet connector 28.

The components and the compressed air flow from the cartridge outlet connector 28 to the mixer inlet connector 27 along the longitudinal mixer axis 24. They are thus oriented in the direction of the longitudinal mixer axis 24.

The connection between the mixer inlet connector 27 and the cartridge outlet connector 28 is secured by a retainer nut 38 which is arranged around the mixer inlet for compressed air 31 and the cartridge outlet for compressed air 37. Other securing means are also possible instead of the retainer nut, such as a bayonet closure, for example.

The outer mixer housing 23, the inner mixer housing 29 and the mixing element 33 are connected to one another via click connections known per se and are thus combined in one structural element, with the click connection not being shown in any detail. Furthermore, the mixer inlet connector 27 and the retainer nut 38 are captively connected to the other components so that the total spray mixer 22 forms one structural unit.

For the connection of the spray mixer 22 to the multicomponent cartridge 10, the spray mixer 22 is placed onto the multicomponent cartridge 10 and the connection is subsequently secured using the retainer nut 38. The placing on and securing is in this respect considered as one work step.

The individual components of the spray mixer 22 are manufactured from plastic by means of an injection molding process. Polypropylene, polyamide, polycaprolactam (polyamide 6) or polybutylene terepththalate can likewise be used for this purpose, for example.

Figure 3:
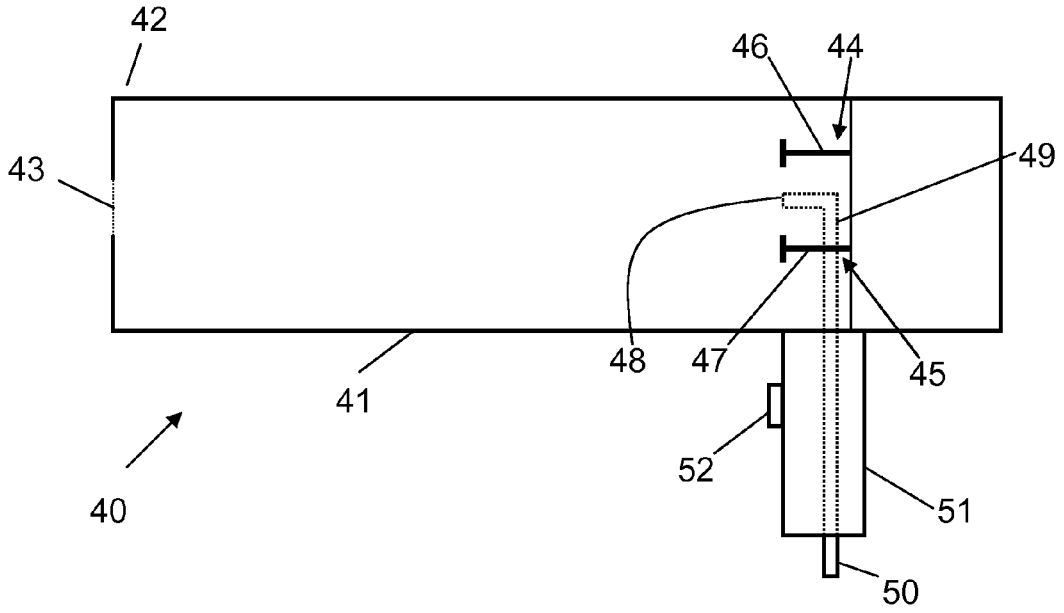
FIG. 3 a dispensing device for a multicomponent cartridge of FIG. 1.

The multicomponent cartridge 10 is inserted into a dispensing device to dispense the components out of the containers 11, 12 of the multicomponent cartridge 10. A dispensing device 40 is shown in schematic form in a sectional representation in FIG. 3. The dispensing device 40 has a receiver element 41 for receiving a multicomponent cartridge. The receiver element 41 has a rectangular cross-section. A multicomponent cartridge can be inserted from above into the receiver element 41 via an opening, not shown, of the receiver element 41. The receiver element 41 has an opening 43 at a front side 42 of the dispensing device 40 which is positioned so that the cartridge outlet connector of the multicomponent cartridge can project through the opening 43.

The dispensing device 40 has a first actuation element 44 and a second actuation element 45. The first actuation element 44 is arranged so that it can displace the piston of the first container and thus actuate it with an inserted multicomponent cartridge. The second actuation element 45 is arranged so that it can displace the piston of the second container and thus actuate it with an inserted multicomponent cartridge. The two actuation elements 44, 45 each have an actuation rod 46, 47 which can be displaced in the direction of the opening 43 by means of compressed air.

The dispensing device 40 has a device outlet for compressed air 48 between the two actuation rods 46, 47, but arranged in a different plane. Since the device outlet for compressed air 48 is arranged in a different plane, it is shown by dashed lines in FIG. 3. The device outlet for compressed air 48 is arranged so that it is connected to the cartridge inlet for compressed air with an inserted multicomponent cartridge. The device outlet for compressed air 48 is connected to a device inlet for compressed air 50 by means of a device passage for compressed air 49. The dispensing device 40 can be connected to a customary compressed air supply via the device inlet for compressed air 50.

The device inlet for compressed air 50 is arranged at a device handle 51 which is connected to the receiver element 41. The device handle 51 serves to allow an operator to securely hold the dispensing device 40. In addition, an activation button 52 is arranged at the dispensing device 51 by means of which the operator can trigger the dispensing, mixing and spraying of the components.

Figure 4:
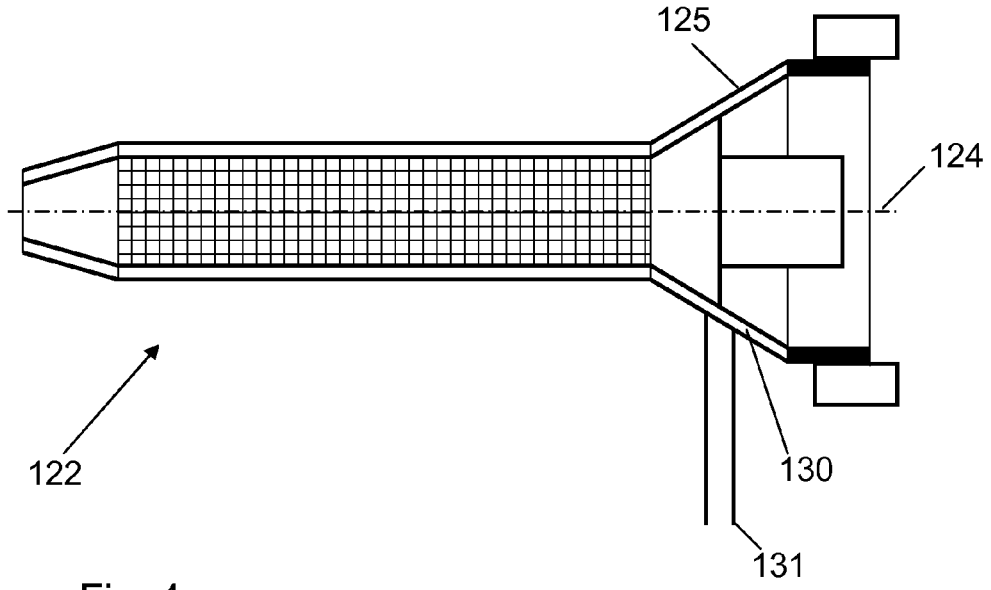
FIG. 4 a spray mixer in a second embodiment.

An alternative embodiment of a spray mixer is shown in FIG. 4. The spray mixer 122 in accordance with FIG. 4 has a similar design to the spray mixer 22 of FIG. 2. For this reason, only the differences of the two spray mixers will be looked at.

In contrast to the spray mixer 22 of FIG. 2, the spray mixer 122 of FIG. 4 does not have any ring-shaped mixer inlet for compressed air which is oriented in the direction of a longitudinal mixer axis 124. Instead, the spray mixer 122 has a mixer inlet for compressed air 131 which is arranged at a mixer start 125 and is oriented perpendicular to the longitudinal mixer axis 124. The mixer inlet for compressed air 131 likewise opens into a mixer passage for compressed air 130. The spray mixer 122 can be connected to a customary compressed air supply via the mixer inlet for compressed air 131.

A multicomponent cartridge to which the spray mixer 122 of FIG. 4 can be connected thus does not have any cartridge outlet for compressed air, but rather only one or two cartridge outlet openings for the components.

The invention claimed is:

1. A spray mixer for mixing and spraying at least two flowable components comprising:

a tubular outer mixer housing extending in a direction of a longitudinal mixer axis from a mixer start up to a distal mixer end;

an inner mixer housing arranged inside the outer mixer housing;

at least one mixing element arranged in the inner mixer housing for mixing the components;

a mixer passage for compressed air extending from a mixer inlet for compressed air arranged at the mixer start up to a mixer outlet opening, the mixer passage being formed between the inner mixer housing and the outer mixer housing, the outer mixer housing, the inner mixer housing and the mixing element being formed as a one-piece construction such that the outer mixer housing, the inner mixer housing and the mixing element are captively connected to one another in an unassembled state of the spray mixer, and a mixer inlet connecter having a first mixer inlet opening and a second mixer inlet opening configured to receive the components, the first mixer inlet opening and the second mixer inlet opening of the mixer inlet connecter being configured to be connected directly to corresponding cartridge outlet openings of a multicomponent cartridge that has pistons to displace the components, the unassembled state being a state in which the spray mixer is not attached to the multicomponent cartridge.

2. The spray mixer in accordance with claim 1, wherein the spray mixer is capable of being connected to the corresponding cartridge outlet openings of the multicomponent cartridge in one work step.

3. The spray mixer in accordance with claim 1, further comprising the first and second mixer inlet openings configured to receive the components and the mixer inlet connector further having the mixer inlet for compressed air.

4. The spray mixer in accordance with claim 3, wherein the mixer inlet connector is oriented to extend along the direction of the longitudinal mixer axis.

5. The spray mixer in accordance with claim 3, wherein the mixing element is a static mixing element.

6. The spray mixer in accordance with claim 5, wherein the mixing element and the mixer inlet connector are made in one piece.

7. The spray mixer in accordance with claim 1, wherein the outer mixer housing, the inner mixer housing and the mixing element are made of plastic.

8. The spray mixer in accordance with claim 1, wherein the outer mixer housing, the inner mixer housing and the mixing element are manufactured by an injection molding process.

9. The spray mixer in accordance with claim 3, wherein the mixer inlet connector is configured to connect the outer mixer housing, the inner mixer housing and the mixing element to the multicomponent cartridge in one step.

10. The spray mixer in accordance with claim 1, wherein the spray mixer is further configured to be connected directly to a cartridge outlet for compressed air.

* * * * *